US005845657A

United States Patent [19]

Carberry et al.

[11] Patent Number: 5,845,657

[45] Date of Patent: Dec. 8, 1998

[54] HAIR STYLING DEVICE

[76] Inventors: Geoff Carberry, #3 - 4732 Stanley Rd. S.W., Calgary, AB, Canada, T2S 2R2; Pamela Sherwood, #87, 123 Queensland Drive SE, Calgary, Ab, Canada, T2J 5J4

[21] Appl. No.: 864,901

[22] Filed: May 29, 1997

[51] Int. Cl.[6] ..... A45D 8/04; A45D 8/34; A45D 8/36

[52] U.S. Cl. ..... 132/273; 132/212; 132/274

[58] Field of Search ..... 132/212, 273, 132/274, 54, 55, 223, 226, 237, 238, 210; 24/469, 470, 471, 472

[56] References Cited

U.S. PATENT DOCUMENTS

| | | | |
|---|---|---|---|
| 541,126 | 6/1895 | Simson . | |
| 731,575 | 6/1903 | Johnston . | |
| 929,848 | 8/1909 | Goin . | |
| 3,126,015 | 3/1964 | Sidelman | 132/7 |
| 3,126,017 | 3/1964 | Sidelman | 132/54 |
| 3,126,018 | 3/1964 | Sidelman | 132/54 |
| 3,126,019 | 3/1964 | Sidelman | 132/54 |
| 3,126,020 | 3/1964 | Sidelman | 132/54 |
| 5,402,805 | 4/1995 | Barinas | 132/144 |
| 5,456,270 | 10/1995 | Wong | 132/210 |
| 5,515,874 | 5/1996 | Denebeim | 132/226 |
| 5,584,309 | 12/1996 | De Beneditis et al. | 132/210 |
| 5,662,128 | 9/1997 | Habibi | 132/210 |

FOREIGN PATENT DOCUMENTS

| | | | |
|---|---|---|---|
| 8806804 | 7/1990 | Brazil | A45D 2/12 |
| 2136524 | 5/1996 | Canada | A45D 8/00 |

*Primary Examiner*—Gene Mancene
*Assistant Examiner*—Pedro Philogene
*Attorney, Agent, or Firm*—Thomas E. Malyszko

[57] ABSTRACT

A hair foundation device for lifting, guiding and holding hair on a user's head has a hollow inner cup within a hollow open ended outer casing. The inner cup has a tubular outer surface, an open bottom end for locating adjacent the user's head, and an opposed top end having flexible spaced tines with openings therebetween for receiving hair. The outer casing has an interior surface for slideably engaging the outer surface of the inner cup, and an exterior surface fitted with bristle type material for gripping the hair being wound thereabout. The inner cup slides relative to the outer casing to adjust the device's height for accommodating a selection of hair lengths and styles. A raised hair-do is formed by gathering hair into locks and stuffing the locks through the openings. One or more of the locks may be wrapped over the bristle type material to help position and secure the device on the user's head. Hairpins or other securing devices are not required, although they may be employed if desired.

18 Claims, 5 Drawing Sheets

HAIR STYLING DEVICE

FIELD OF THE INVENTION

The present invention relates to hair styling devices generally, and in particular to a device and method for lifting, guiding and holding hair of various lengths on a user's head.

BACKGROUND OF THE INVENTION

Upstanding hair styles, also referred to as raised hair-dos, up-dos, buns or beehives, are desirable but difficult to achieve, particularly due to the number of hairpins, bobby pins, combs or clips which must be employed to hold the hair-do together. People with relatively short hair face even greater difficulties in achieving desirable results. Sometimes, a small support structure or object must be employed as the core or foundation of the raised hair-do to help shape and hold the hair-do.

A known hair support device for raised hair-dos is shown in U.S. Pat. No. 3,126,020 to Sidelman. This device suffers from several disadvantages, however. Hairpins are required to form and secure hair to the device. Such pins may be visible and ruin the look of the hair-do. They may also be uncomfortable and may injure the user or others. While the Sidelman device is compressible, it cannot be fixed to a selected height suitable for a particular user. The user must keep the device compressed with one hand while trying to form a raised hair-do with the other. Such a task is difficult to perform as the device has a tendency to revert to its fully expanded form during styling and afterwards. The device also lacks lateral stiffness.

What is therefore desired is a novel device for forming raised hair-dos which overcomes the limitations and disadvantages of prior styling devices and methods. Preferably it should facilitate the shaping of hair into raised hair-dos, and should have means for positioning and securing the device to the user's head, without the need for additional securing devices such as hairpins, combs or the like. The device should be adjustable to accommodate a desired or selected height of hair-do, and should resist movement away from the selected height during use.

SUMMARY OF THE PRESENT INVENTION

The invention provides in a first aspect a device for supporting and styling hair into a raised hair-do atop a user's head comprising: an annular sleeve element having a radially outer surface and a radially inner surface defining a cavity, said outer surface being adapted to removably receive at least a portion of said hair thereon for positioning and securing said device on the user's head; and, an annular core element located within said cavity abutting said inner surface of the sleeve element and having a first end portion contoured to define a plurality of openings for threading at least a portion of said hair therethrough to generally form said hair-do.

In a second aspect, the invention provides a device for raising and shaping hair atop a user's head comprising: an annular body having a cavity; a resilient first end portion contoured to define a plurality of openings adapted to allow a user to insert said hair through said cavity; and, an outside surface having a gripping means for engaging said hair; wherein said openings and said gripping means can be used to secure hair to said device and hence to secure said device to said user's head, and wherein said hair is generally shaped by wrapping at least a portion of said hair about said outside surface and by passing at least a portion of said hair through said openings.

In a third aspect, the invention provides a hair foundation device for lifting, guiding and holding hair on a user's head which comprises, in combination: a hollow inner cup having a tubular outer surface, an open bottom end for locating adjacent the user's head, and a partially closed top end opposite said bottom end for receiving at least some of said hair; and, a hollow open ended outer casing having an interior surface abutting said outer surface of the inner cup, and an exterior surface with means for gripping at least some of said hair about said casing.

In a fourth aspect, the invention provides a method of shaping hair into a raised hair-do atop a user's head comprising: providing a device having:

a tubular sleeve element having a radially inner surface defining a cavity, a radially outer surface having a gripping means to removably receive at least a portion of said hair, an open top end and an opposed open bottom end; and, a hollow tubular core element located within said cavity and slideably engaging said inner surface of the sleeve element, and having an upper end portion contoured to define a plurality of flexible tines forming a plurality of openings therebetween;

adjusting the device to obtain a desired hair-do elevation by sliding said core element relative to said sleeve element into a plurality of positions between a filly retracted position wherein said upper end portion of the core element is substantially flush with said top end of the sleeve element, and a fully extended position wherein said upper end portion protrudes from said top end to elevate said openings above said top end; gathering said hair into locks; and, stuffing said locks through said openings and arranging said hair until a desired hair-do is formed.

BRIEF DESCRIPTION OF THE DRAWING FIGURES

Embodiments of the invention will now be described, by way of example only, with reference to the accompanying drawings, wherein.

DESCRIPTION OF PREFERRED EMBODIMENT

Figure 2:
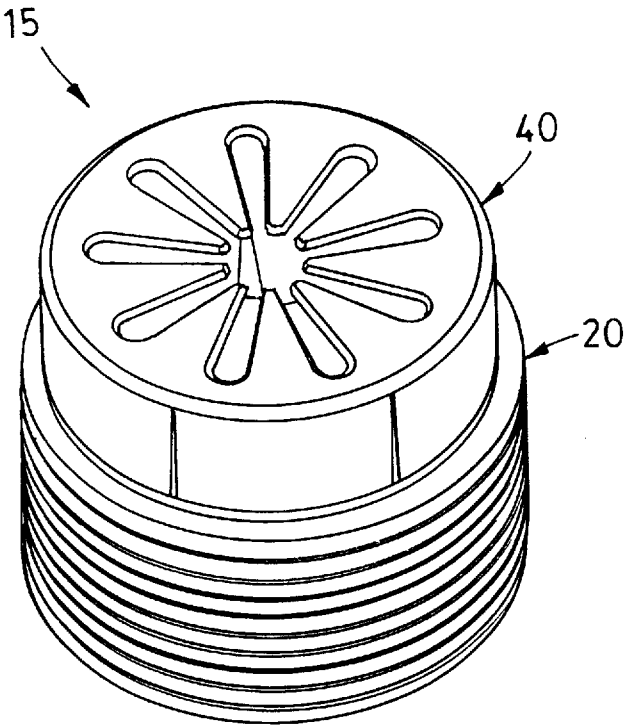
FIG. 2 shows the device of FIG. 1 in an extended position.
Figure 1:
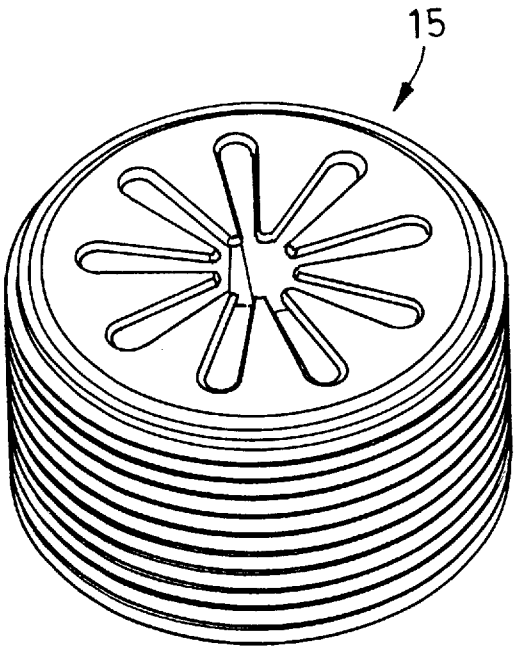
FIG. 1 is a perspective isometric view of a hair styling device according to a preferred embodiment of the present invention shown in a fully retracted position.

Reference is first made to FIGS. 1 and 2 which show a device (generally indicated by reference numeral 15) for supporting and styling hair into a raised hair-do atop a user's head without the aid of pins, combs or the like. The device is suitable for various hair styles, but particularly for up-dos, buns and beehives. The device is generally of a two-part construction having an inner core 40 slideably located within an outer sleeve 20.

Figure 4:
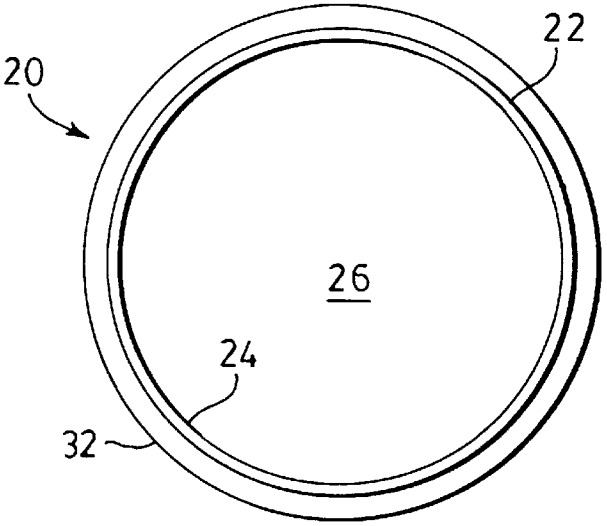
FIG. 4 is a plan view of the outer casing of FIG. 3.
Figure 5:
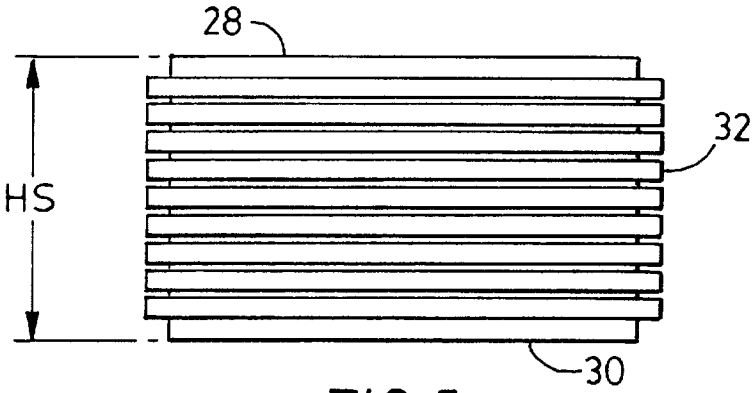
FIG. 5 is an elevated view of the outer casing of FIG. 3.
Figure 3:
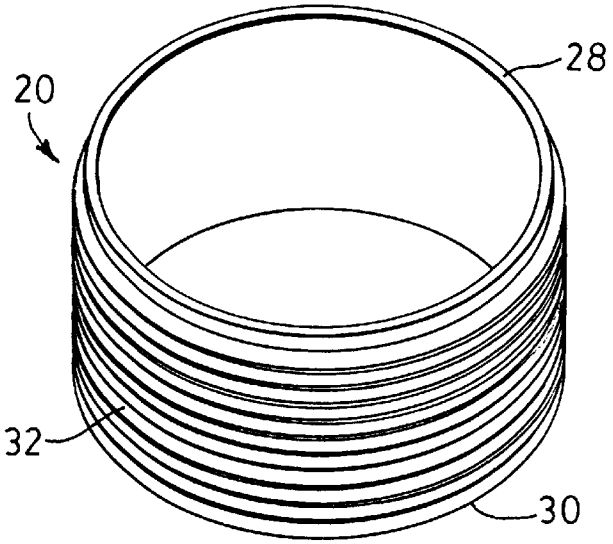
FIG. 3 is a perspective isometric view of an outer casing of the device of FIG. 1.
Figure 7:
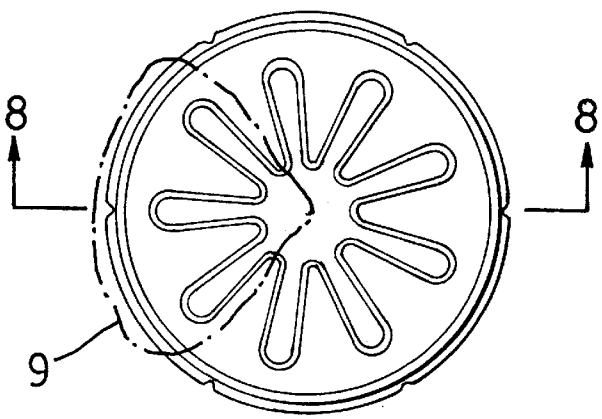
FIG. 7 is a plan view of the inner cup of FIG. 6.

Referring now to FIGS. 3–5 as well, the outer sleeve or casing 20 has an annular body which is circular in transverse cross-section (i.e. plan view) to form a cylinder in the preferred embodiment. Other shapes, such as ellipses, squares, etc., may also be suitable for other purposes such as aesthetics, but are not shown herein. The sleeve 20 has a radially outer surface 22 and a smooth radially inner surface 24 defining a cavity 26. The cylindrical body has a first or top edge 28 and a second or bottom edge 30 for contacting the user's head. The outer sleeve may be made symmetrically reversible. A good portion of the outer surface 24 is fitted with a surfacing material 32 for gripping the user's hair during use of the device, and for releasing the hair upon removal of the device, as described later. The amount of material 32 used should be enough to adequately fix the device on the user's head, while minimizing the discomfort and effort required to release the gripped hair from the sleeve. Good results have been achieved by ringing the outer surface 22 with longitudinally spaced strips of bristle type materials such as the hook portion of hook and loop materials, one of which trades under the trade name VELCRO. The surfacing material may be formed integrally with the sleeve 20 (as might be available using a blow molding process, for example) or may be attached by adhesives or other suitable means.

Referring now to FIGS. 6–9, the inner core or cup 40 has an annular body with a smooth radially outside surface 42 and a radially inside surface 44 defining an inside space 46. The outside surface 42 is sized and shaped to generally slidingly engage the inner surface 24 of the sleeve 20. Hence, the core in the preferred embodiment is also circular in cross-section to form a cylinder. The outside surface 42 includes a series of longitudinal ribs 48 spaced at intervals about the core. The ribs 48 are slightly raised above the surface 42 to abut the inner surface 24 and to provide or enhance an interference or friction fit between the core and sleeve, yet to allow the core to be slid within the sleeve, as described below.

Figure 8:
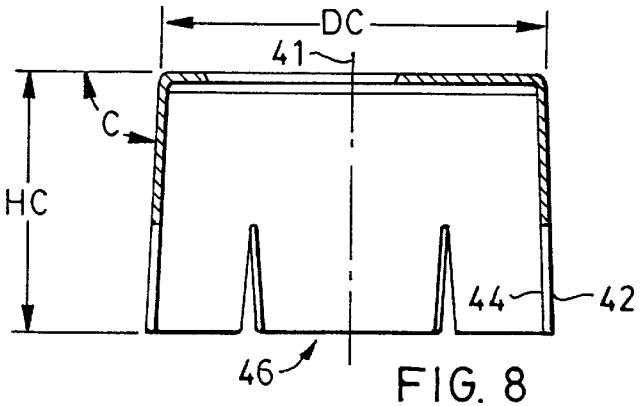
FIG. 8 is a cross-sectional view along line 8—8 of FIG. 7.
Figure 6:
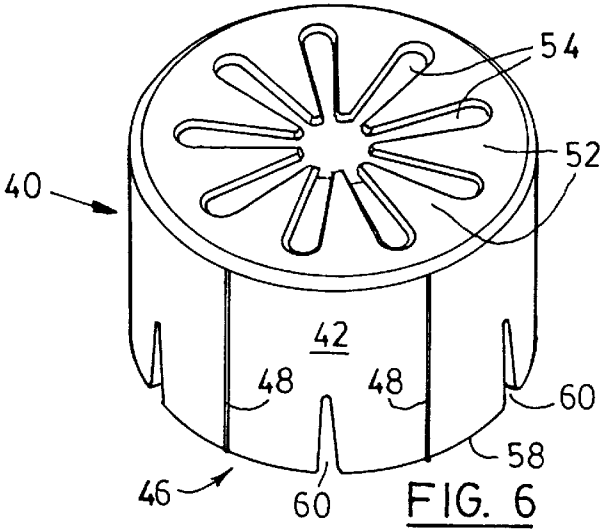
FIG. 6 is a perspective isometric view of an inner cup of the device of FIG. 1.
Figure 9:
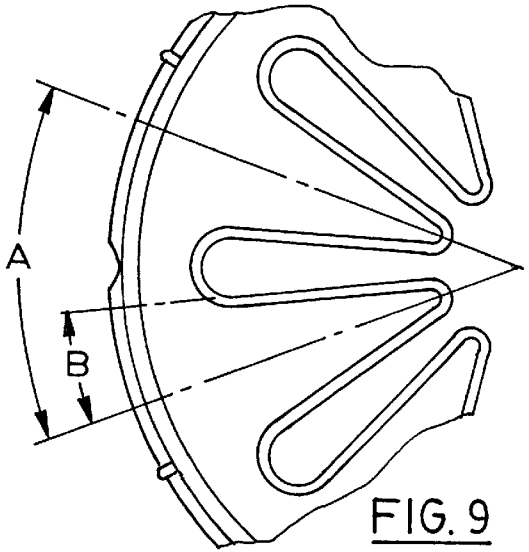
FIG. 9 is a close-up view of a portion of the inner cup as indicated by reference numeral 9 in FIG. 7.

A first or upper end portion 50 is contoured to form a number of flexible tines or spokes 52 which extend radially inwardly from the core's body 50 in a plane generally perpendicular to the core's longitudinal centerline 41 (FIG. 8). The tines 52 are circumferentially spaced to define elongate openings or slots 54 between adjacent tines, including a central opening 56 formed by the tips of the tines. The tines 52 have smooth edges to avoid discomfort or injury to the user's fingers and to the hair being inserted about the tines as described later. Referring specifically to FIG. 9, good results have been had in the preferred embodiment using nine tines, each pair of which is spaced an angle A of 40 degrees (centerline to centerline), and where the radial distance B from the tine's centerline to its edge is 15 degrees. Hence, each opening 54 has an approximate radial extent of 10 degrees.

A lower end 58 of the core forms an open end for passing hair therethrough, if desired. A number of circumferentially spaced compression slots 60 are provided along the lower end 58 to absorb the core's increased diameter at that end created by the need for a draft when molding the core. In other words, the core increases in diameter or "spreads out" from the upper end 50 as indicated by the angle C (88.5 degrees, providing for a draft angle of 1.5 degrees). Such spreading may not be required for other production methods. It may now be better understood that the earlier mentioned ribs 48 are required to make up for the changes in spacing between the core and sleeve as the core is extended and retracted in the sleeve. Good results have been had with ribs 48 made of polypropylene and an interference of 0.030 inches when the core is extended half way out the sleeve.

As noted earlier, the core 40 is slideable within the sleeve 20 into numerous (i.e. a continuous range of) positions between a fully retracted and a fully extended position. FIG. 1 shows the device 15 in the fully retracted position where the core 40 is seated within the sleeve 20, namely the core's upper end 50 and tines 52 are generally flush with the sleeve's top edge 28. In this position the core's lower end 58 is also flush with the sleeve's bottom edge 30, although it can protrude somewhat if desired. FIG. 2 shows the device in an extended position where the core 40 protrudes from the sleeve, thereby elevating the core's upper end 50 and tines 52 above the sleeve's top edge 28 (and, ultimately, the user's head). Such extension enables the user to create raised hair-dos with extra height over those when the device is retracted. The core's height HC (FIG. 8) should be as large as possible to provide the maximum possible extension, which in the preferred embodiment is the same as the height HS of the sleeve (FIG. 5) so that the core does not protrude from the sleeve when fully retracted. Good results have been had with heights HC and HS of about 1.6 in. (approx. 4.1 cm) where the diameter DC of the core is about 2.5 in. (approx. 6.4 cm). It will also be appreciated that in a "fully" extended position, a sufficient portion of the core must remain seated within the sleeve to maintain lateral stability of the device and to avoid having the core pop out of the sleeve. The portion of core which must remain seated will depend on the stiffness of materials used and the tightness of the friction fit between the core and sleeve. A mark, visual aid or other stop means (not shown) apparent to those skilled in the art may be provided on the core's outside surface 42 to indicate to a user when the fully extended position is reached.

The device may be constructed of various materials which are light weight yet provide flexibility and stiffness as required. Good results have been achieved using thermoplastic material, particularly polypropylene, with enough stiffness to provide the sleeve and core bodies, 20 and 40 respectively, with the required stability noted earlier when the device is extended, yet with some flexibility, or "spring characteristic", for the ribs 48 to provide the friction fit noted above to maintain (i.e. "lock" or "set") the core in a selected extended position and resist movement away from such position during use of the device. Hence, both of the user's hands are free to maneuver the device and style hair as required. The polypropylene material also provides in a molding process the necessary flexibility to the tines 52 for a user's fingers to reach through the tines into the cavity 26 as described below. As well, the material used should be of a "food-grade" since the device is in contact with a user's skin, namely the scalp.

Figure 11:
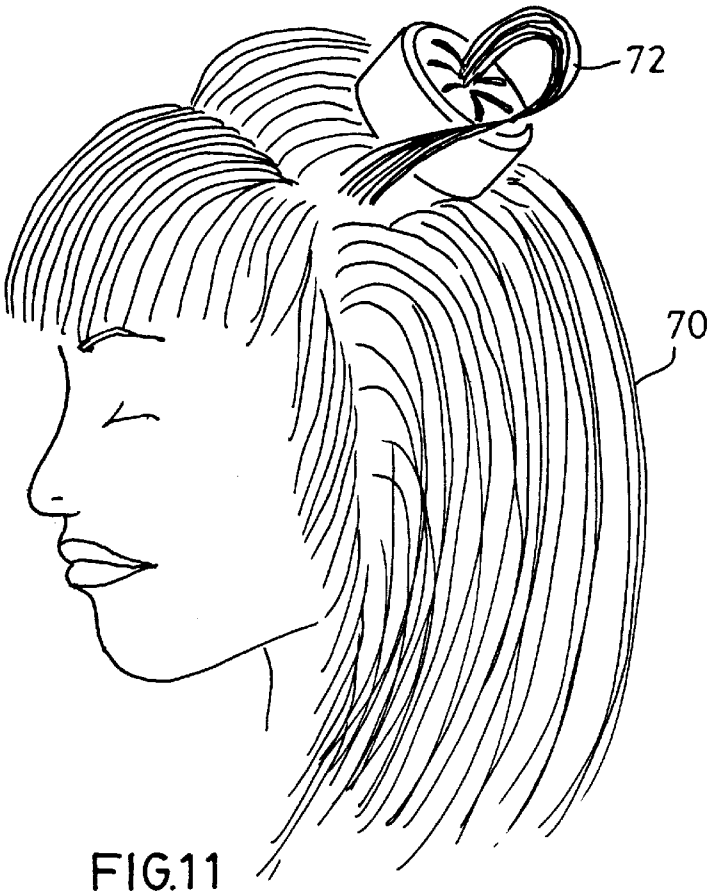
FIGS. 10 and 11 show one method of installing the styling device on a user's head.
Figure 10:
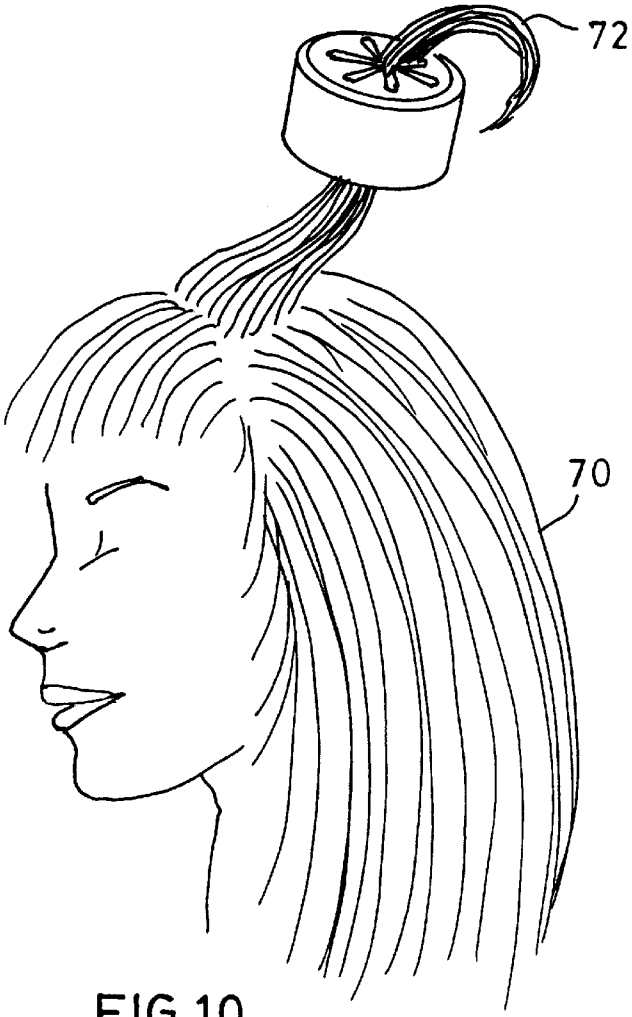
Figure 13:
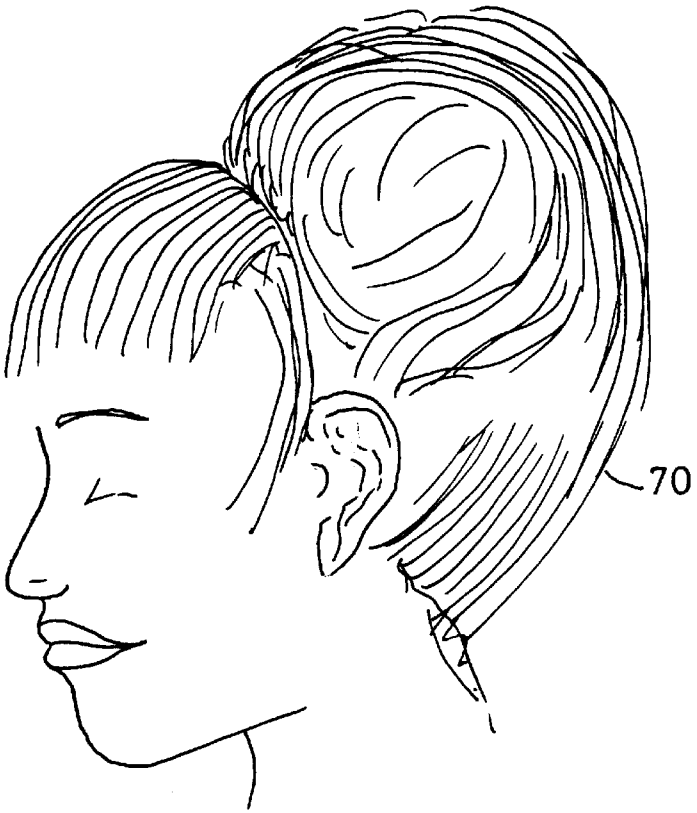
Figure 12:
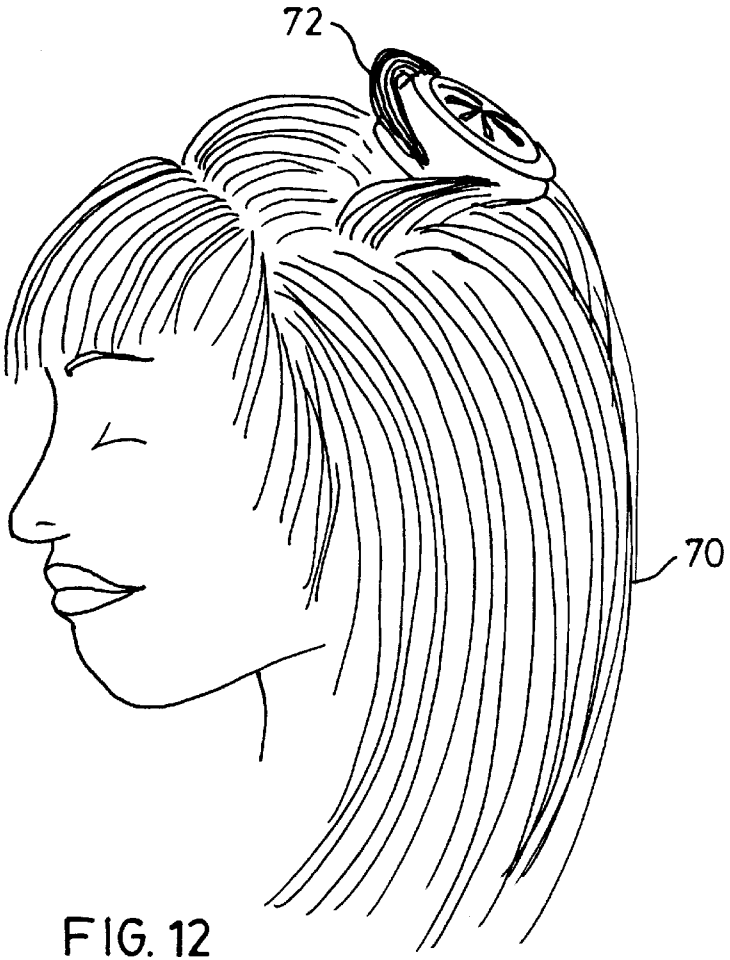
FIG. 12 shows another method of installing the styling device on a user's head; and, FIG. 13 shows an example of a raised hair-do formed using the above styling device and methods.

It may now be better appreciated how the preferred embodiment of the device is used with reference to FIGS. 10–13. FIGS. 10 & 11 show a first method of installing the device 15 on the user's head. The device is first adjusted to a selected position between the fully retracted and filly extended positions noted earlier. A fully retracted position is illustrated in FIGS. 10 & 11. A clump or bunch of hair 70 is then gathered into a first tress or lock 72 and passed through the open bottom 30 of the device and the core's inside space 46 (which coincides with the sleeve's cavity 26), and is pushed through the openings 54 in the core's upper end 50 and the device is lowered or placed onto the user's head (FIG. 11). While the device is being lowered the lock 72 should be located mostly in the central opening 56 to minimize resistance and obstruction to this lowering motion. Once on the user's head, the lock is firmly wrapped about the sleeve's outer surface 22 to grip the surfacing material 32, thereby securing the device in place. In doing so, the lock is pulled from the central opening 56 laterally into a tight engagement with one or more of the openings 54. Optionally, one or more locks may then be bunched and wrapped about the outer surface 22 (without being pushed through the cavity 26) for further securing the device. Next, more hair is gathered into locks and stuffed through the openings 54 into the cavity 26, and arranged into a raised hair-do as shown in FIG. 13.

A second method of shaping hair into a raised hair-do with the device 15 is to place the height-adjusted device on the user's head and to wrap a first lock of hair about the sleeve's outer surface 22 (FIG. 12) without first passing the lock through the cavity 26. Once one or more such locks are wrapped to firmly hold the device in place, hair may be then stuffed between the tines 52 as with the earlier method to form a raised hair-do (FIG. 13). It is noted that with very long hair a formed lock may be wrapped about the sleeve and, if further wrapping is unnecessary, the remainder of the lock may be stuffed between the tines into the cavity.

In a third method of styling, it is possible to omit wrapping hair about the sleeve and secure the device to the user's head by merely stuffing hair from outside the device through the openings into the cavity. Such securement may be adequate in particular circumstances.

A fourth method of styling is also available where the hair is wrapped about the sleeve to secure the device (as in the second method—FIG. 12), and then to continue wrapping more hair about the sleeve and over the top of the device to hide it from view, without stuffing any hair between the tines.

As will now be apparent, one advantage of the present device is that no additional securing devices, such as hairpins, combs, wooden sticks or the like are required to secure the device to the user's head and to create a variety of hairstyles. Another advantage is the ease with which various heights of hair-dos which can be accommodated by merely slideably adjusting the position of the core relative to the sleeve, and the selected height is "locked in" via the frictional engagement of the core with the sleeve. The height may also be adjusted after forming the hair-do by gripping the core through the hair with one hand and sliding it in or out of the sleeve with the other hand. Further, the present device also allows creation of raised hair-dos for hair of relatively short length as compared to prior art devices. Yet another advantage is that the device may be "self-administered", namely the user alone may easily install the device and create the hairdo without the aid of a third party (e.g. a hair-dresser).

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below. For example, the number and size of tines 52 may be varied to alter the shape or size of the openings 54 and 56. In addition, slots and holes may be incorporated in the design of the device to accommodate additional securing devices, although this is not preferred.

We claim:

1. A device for supporting and styling hair into a raised hair-do atop a user's head comprising:

an annular sleeve element having a radially outer surface and a radially inner surface defining a cavity, said outer surface being adapted to removably receive at least a portion of said hair thereon for positioning and securing said device on the user's head; and, an annular core element located within said cavity abutting said inner surface of the sleeve element and having a flexible first end portion contoured to provide at least one opening for threading at least a portion of said hair therethrough to generally form said hair-do, said at least one opening being defined by a plurality of elongate tines extending radially inwardly from said core element to form elongate slots therebetween.

2. The device of claim 1 wherein a surfacing material envelopes at least a portion of said outer surface of the sleeve element for removably retaining said hair thereon.

3. The device of claim 2 wherein said surfacing material comprises the hook portion of a hook and loop material.

4. The device of claim 1 wherein said core element is movable relative to said sleeve element into a plurality of positions between a fully retracted position wherein said core element is seated fully within said sleeve element, and a fully extended position wherein said core element protrudes from said sleeve element to elevate said first end portion away from said sleeve element for providing extra height to said raised hair-do.

5. The device of claim 4 wherein said core element has an outside surface which slideably engages said inner surface of the sleeve element, said outside surface having a plurality of ribs spaced thereabout to provide a friction fit between said sleeve and core elements for holding the core element in a selected position relative to the sleeve element during use.

6. The device of claim 5 wherein said sleeve and core elements are generally cylindrically shaped, and at least said first end portion of the core element is formed of a resilient thermoplastic material.

7. A device for raising and shaping hair atop a user's head comprising: an annular body having a cavity; a resilient first end portion contoured to define a plurality of elongate slots adapted to allow a user to insert said hair through said cavity; and, an outside surface having a gripping means for engaging said hair; wherein said opening and said gripping means can be used to secure hair to said device and hence to secure said device to said user's head, and wherein said hair is generally shaped by wrapping at least a portion of said hair about said outside surface and by passing at least a portion of said hair through said opening.

8. The device of claim 7 wherein said annular body comprises a tubular core portion having an open second end and an opposed first end for supporting said first end portion, and an open ended tubular sleeve portion surrounding said core portion and slideably engaged therewith.

9. The device of claim 8 wherein said core portion is slideable between a first position wherein said first end portion is substantially flush with a first end of said sleeve portion; and a second position where said first end portion protrudes from said first end of the sleeve portion.

10. A hair foundation device for lifting, guiding and holding hair on a user's head which comprises, in combination:

a hollow inner cup having a tubular outer surface, an open bottom end for locating adjacent the user's head, and a partially closed top end opposite said bottom end for receiving at least some of said hair; and a hollow open ended outer casing having an interior surface abutting said outer surface of the inner cup, and an exterior surface with means for gripping at least some of said hair about said casing.

11. The hair foundation device of claim 10 wherein said inner cup is slidingly moveable relative to said outer casing for selectively spacing said closed top end from said user's head to accommodate a selection of hair lengths and styles.

12. The hair foundation device of claim 11 wherein said partially closed top end of the inner cup comprises a plurality of flexible, smooth-edged tines forming an opening to direct and engage said hair, wherein said hair may be passed through said opening from any one of the said bottom end, said top end, and both.

13. The hair foundation device of claim 12 wherein said gripping means comprises a bristle type material covering at least a portion of said exterior surface of the outer casing for securing said outer casing to the user's head by winding hair thereonto.

14. The hair foundation device of claim 13 wherein said outer casing and at least a part of said inner cup is produced of a generally rigid, food-grade polypropylene material.

15. A method of shaping hair into a raised hair-do atop a user's head comprising:

(a) providing a device having:

(i) a tubular sleeve element having a radially inner surface defining a cavity, a radially outer surface having a gripping means to removably receive at least a portion of said hair, an open top end and an opposed open bottom end; and, (ii) a hollow tubular core element located within said cavity and slideably engaging said inner surface of the sleeve element, and having an upper end portion contoured to define a plurality of flexible tines forming a plurality of slots therebetween;

(b) adjusting the device to obtain a desired hair-do elevation by sliding said core element relative to said sleeve element into a plurality of positions between a fully retracted position wherein said upper end portion of the core element is substantially flush with said top end of the sleeve element, and a fully extended position wherein said upper end portion protrudes from said top end to elevate said openings above said top end;

(c) gathering said hair into locks; and, (d) stuffing said locks through said slots and arranging said hair until a desired hair-do is formed.

16. The method of claim 15 further comprising locating said bottom end of the tubular sleeve adjacent the user's head prior to said stuffing.

17. The method of claim 16 further comprising wrapping at least one of said locks about said outer surface of the sleeve to engage said gripping means for positioning and securing said device on the user's head after said locating and prior to said stuffing.

18. The method of claim 15 further comprising, before proceeding with said stuffing, passing a first lock of hair through said cavity from the bottom end to the top end and out through said openings, locating said bottom end of the tubular sleeve adjacent the user's head, and wrapping said first lock about said outer surface of the sleeve to engage said gripping means to position and secure said device on the user's head.

* * * * *